United States Patent [19]

Morita

[11] Patent Number: 4,895,456

[45] Date of Patent: Jan. 23, 1990

[54] SHOPPING BAGS

[75] Inventor: Shigenari Morita, Higashinariku, Japan

[73] Assignee: The Pack Kabushiki Kaisha, Higashinariku, Japan

[21] Appl. No.: 294,199

[22] Filed: Jan. 6, 1989

[51] Int. Cl.[4] ..... B65D 33/06

[52] U.S. Cl. ..... 383/20; 383/107

[58] Field of Search ..... 383/6, 20, 17

[56] References Cited

U.S. PATENT DOCUMENTS

| | | | |
|---|---|---|---|
| 1,432,150 | 10/1922 | Bertin | 383/20 |
| 1,520,071 | 12/1924 | Nestor | 383/20 |
| 2,150,043 | 3/1939 | Stark | 383/20 |
| 2,237,324 | 4/1941 | Wolk | 383/20 |
| 3,021,767 | 2/1962 | Hamilton | 383/6 |
| 3,034,699 | 5/1962 | Steen | 383/20 |
| 3,493,166 | 2/1970 | Smith et al. | 383/20 |

*Primary Examiner*—Stephen P. Garbe

*Attorney, Agent, or Firm*—Collard, Roe & Galgano

[57] ABSTRACT

A shopping bag having handles, which are passed through slits produced a foldable tab extended from the rim of the bag. The handles are bonded to reinforcement straps attached to the bag, over which the foldable tab is folded with the handles protruded through the handle-receiving slits.

4 Claims, 3 Drawing Sheets

SHOPPING BAGS

BACKGROUND OF THE INVENTION

The present invention relates to a shopping bag with handles for carrying shoppers' purchases, and more particularly to a shopping bag having its handles affixed thereto firmly so as to withstand a relatively heavy load carried by the bag.

A shopping bag comprises a bag portion for containing purchases, and handles attached to the rim of the bag portion. Without handles any shopping bag cannot be useful. However the problem is in the attachment of the handles to the bag portions which are made of fragile, pliable material such as paper or plastic sheet. On the other hand, the shopping bag carrys purchases, and all the load concentrate on the joined part of handles to the bag portion. In many known shopping bags the handles are attached to the inside of the rim of the bag portion through a reinforcement sheet. Nevertheless, the handles are often torn from the reinforcement sheet under a heavy load carried by the bag portion. Another concern is about the achievement of economical production. The shopping bag can be costly. Tough handles and the low cost production of shopping bags represent a dilemma to the manufacturers.

SUMMARY OF THE INVENTION

The present invention is to provide a shopping bag which solves the dilemma pointed out above. Thus an object of the present invention is to provide a shopping bag having its handles firmly attached thereto so as to withstand a relatively heavy load carried by the bag portion.

Another object of the present invention is to provide a shopping bag capable of economical production.

According to the present invention there is provided a shopping bag comprising a bag portion, a bottom portion, and a pair of handles, the bag portion including a foldable tab in its rim, the foldable tab including slits for allowing the handle to pass through, each slit including a first portion produced inwardly from the edge of the tab and a second portion lengthwisely continuous to the first slit at a point spaced from the border between the rim and the bag portion, and the opposite ends of each handle being bonded to a reinforcement strap attached to the bag portion, the foldable tab being folded over the reinforcement straps with the handles protruded through the second portions of the handle-receiving slits.

Other objects and advantages of the present invention will become more apparent from the following detailed description, when taken in conjunction with the accompanying drawings which show, for the purpose of illustration only, one embodiment in accordance with the present invention.

DETAILED DESCRIPTION OF THE INVENTION

Figure 1:
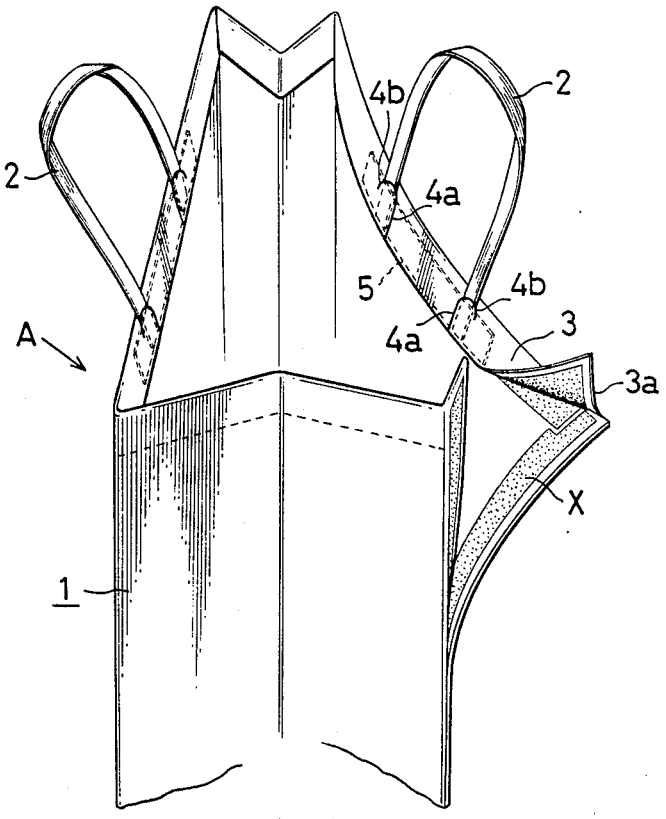
FIG. 1 is a perspective view explaining a shopping bag according to the present invention.
Figure 5:
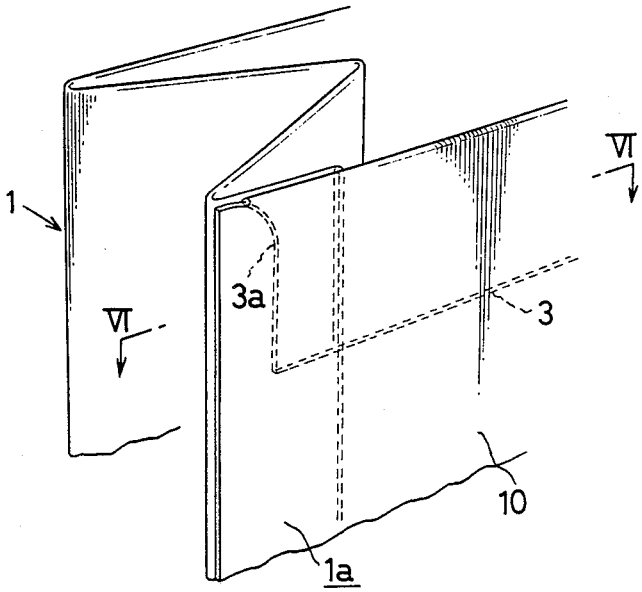
FIG. 5 is a perspective view explaining an upper part of the bag portion.
Figure 6:
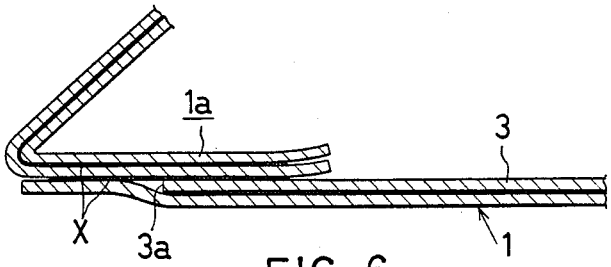
FIG. 6 is a cross-sectional view taken along the line VI—VI in FIG. 5.

The shopping bag (A) of the present invention includes a bag portion 1, and a pair of handles 2 shape like a gate. The bag portion 1 is made of a pliable material such as paper or plastic sheet 10. Two sheets 10 are joined at their longitudinal rims with the use of an adhesive (X) with folds therebetween as shown in FIGS. 1 and 5. At this stage the bag portion is cylindrical. The lower parts of the joined sheets are folded to form a bottom as shown in FIG. 5.

Figure 2:
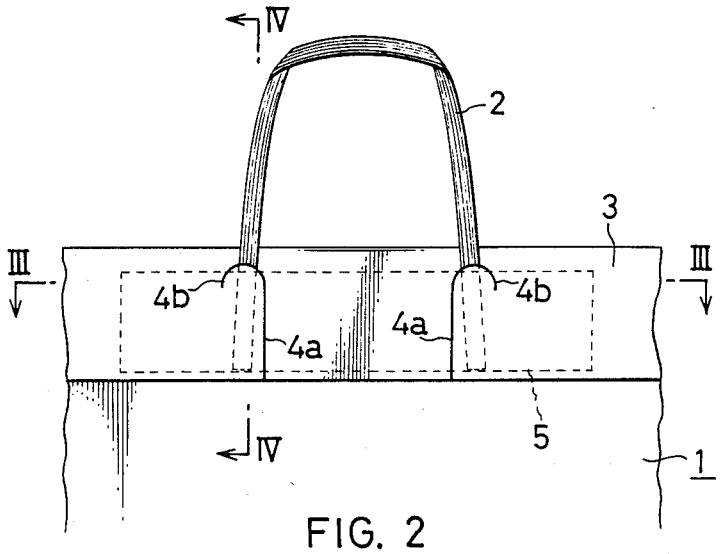
FIG. 2 is a front view showing a finished shopping bag according to the present invention.
Figure 3:
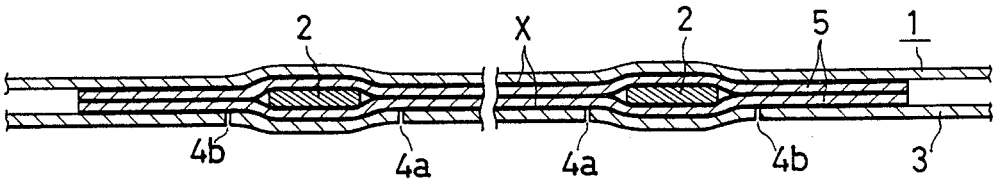
FIG. 3 is a cross-sectional view taken along the line III—III i FIG. 2.
Figure 4:
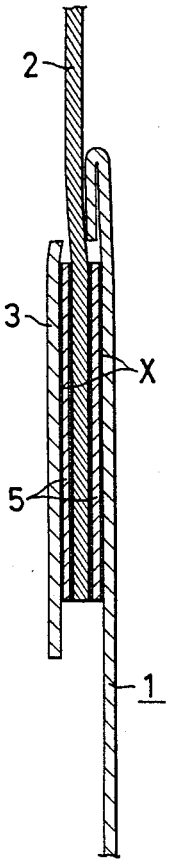
FIG. 4 is a cross-sectional view on an enlarge scale taken along the line IV—IV in FIG. 2.
Figure 7A:
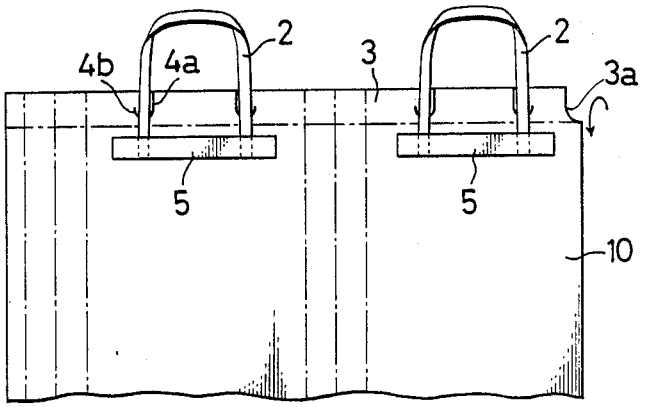
FIGS. 7A to 7D are front views explaining the process of fabricating the shopping bag according to the present invention.
Figure 10:
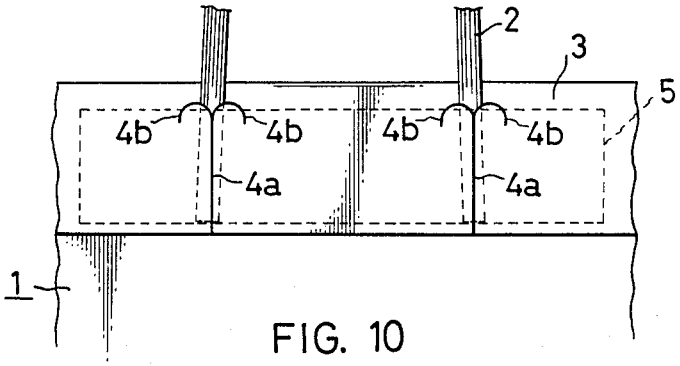
FIG. 10 is a modified version of the handle-receiving slit.

As shown in FIGS. 1 and 2, the rim of the bag portion 1 includes a foldable tab 3, which is folded inwardly to make a doubled rim. As best shown in FIG. 2, the foldable tab 3 is provided with slits 4. The slit 4 includes a first portion 4*a* produced inwardly from the edge of the tab 3 as best shown in FIG. 7A. The slit 4 also includes a second portion 4*b* formed lengthwise of the foldable tab 3 at a point spaced from the border between the rim and the body portion. The illustrated second portion 4*b* of slit is arch-shaped. But the shape is not limited to this configuration. For example FIG. 10 shows a modified configuration of the second portion 4*b*, which is characterized by being branched from the first portion 4*a* of slit in opposite directions. This modified version allows the handle to be displaceable in the second portion of slit 4*b*.

Each end of the handle 2 is sandwiched between two reinforcement straps 5 made of a thick material. The straps 5 having the handles 2 are bonded to the inside of the rim of the bag portion 1 with the adhesive (X). At this stage the foldable tabs 3*a* are not yet folded.

Figure 9A:
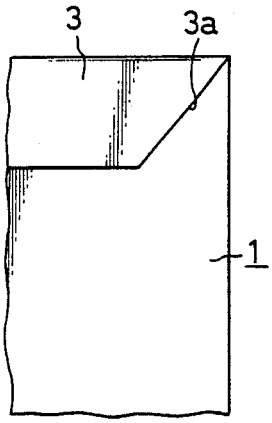
Figure 9B:
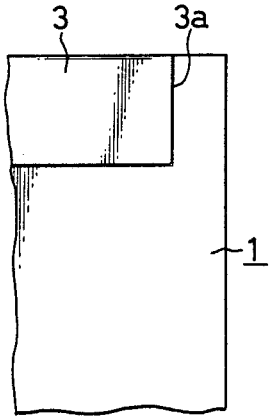
Figure 9C:
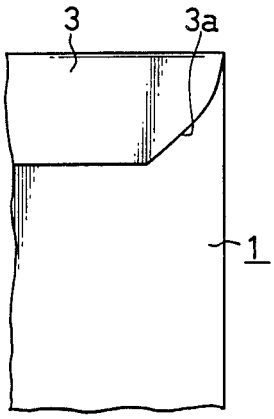

As described above, the bag portion 1 is made by joining two sheets at each mating zone 1*a* with the adhesive (X) as shown FIG. 1. In this way the mating zones 1*a* of the two sheets are overlaid, over which the tab 3 is folded. Thus the multi-layer corner is formed which presents an ugly appearance against the consumers' liking for fancy shopping bags. To avoid the multi-layer corner, the mating end of the foldable tab 3 is cut away at 3*a* as shown in FIG. 5. The cutaway portion 3*a* is helpful in avoiding the thick corner at the closing part of the bag portion 1, and appear to be smart. The shapes of the cutaway portion 3*a* can be various as shown in FIGS. 9A to 9C. In common with them a substantial part of the cutaway portion 3*a* is spaced form the side of the bag portion 1.

Figure 7B:
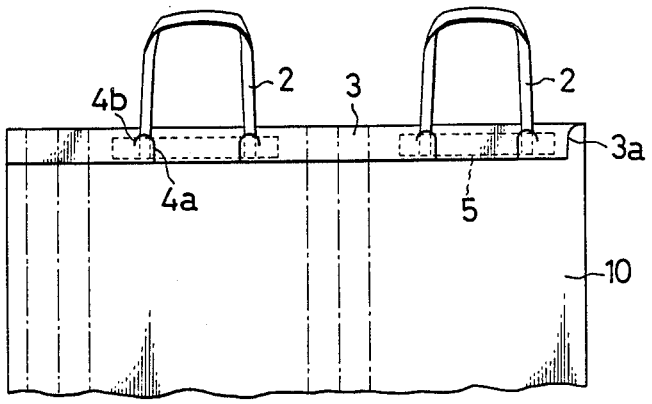
Figure 7C:
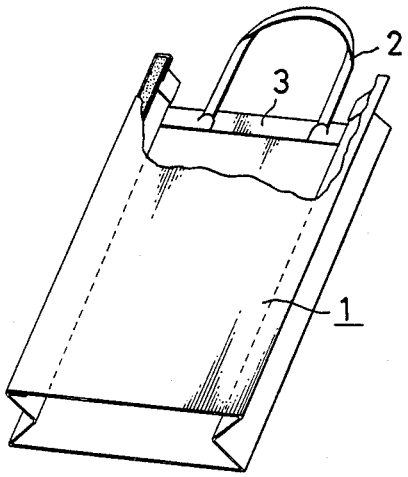
Figure 7D:
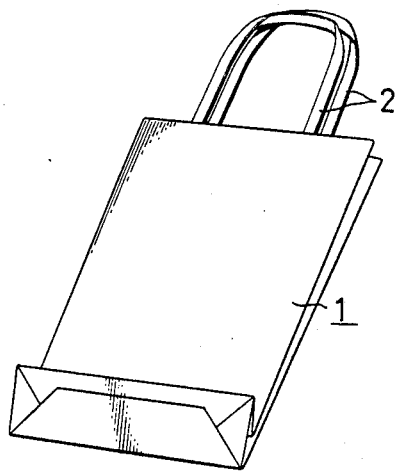
Figure 8:
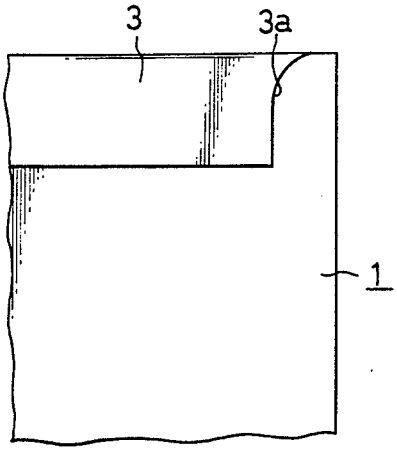
FIGS. 8 and 9A to 9C are front views showing examples of the end portions of the foldable tab.

The shopping bag (A) of the present invention is automatically fabricated as follows:

First, the handles 2 are sandwiched between and adhered to the reinforcement straps 5, which are bonded to the inside of the open end of the bag portion 1. At this stage the bag portion 1 is in a state of sheet 10 as shown in FIG. 7A. Then the foldable tabs 3 are folded over the straps 5 such that each handle 2 is protruded through the second portion 4*b* of slit as shown in FIG. 7B. The facing sheets 10 are folded along the border therebetween so as to form a cylindrical bottomless bag portion shown in FIG. 7C. Finally the bottom is formed as shown in FIG. 7D by folding the lower parts of the cylindrical bag portion.

The open end of the bag portion 1 is lined with the folded taps 5 and the reinforcement straps 5, thereby increasing the strength enough to withstand a load carried by the bag portion.

What is claimed is:

1. A shopping bag comprising a bag portion, a bottom portion, and a pair of handles, the bag portion including a foldable tab in its rim, the foldable tab including slits for allowing the handle to pass through, each slit including a first portion extending inwardly from the edge of the tab and a second portion continuous with, but extending generally transversely to, said first portion and being inwardly spaced from said rim of said bag portion and the opposite ends of each handle being bonded to a reinforcement strap attached to the bag portion, the foldable tab being folded over the reinforcement straps with the handles protruded through the second portions of the handle-receiving slits.

2. A shopping bag as defined in claim 1, wherein the second portion of slit are branched in opposite directions from the first portion of slit.

3. A shopping bag as defined in claim 1, wherein the second portion of slit is arch-shaped.

4. A shopping bag as defined in claim 1, wherein the foldable tab is provided with a cutaway portion at its mating end.

* * * * *

US004895456B1

REEXAMINATION CERTIFICATE (1955th)

United States Patent [19]

[11] B1 4,895,456

Morita

[45] Certificate Issued Mar. 23, 1993

[54] SHOPPING BAGS

[75] Inventor: Shigenari Morita, Higashinariku, Japan

[73] Assignee: The Pack Kabushiki Kaisha, Osaka, Japan

Reexamination Request:
No. 90/002,531, Dec. 4, 1991

Reexamination Certificate for:

| | |
|---|---|
| Patent No.: | **4,895,456** |
| Issued: | **Jan. 23, 1990** |
| Appl. No.: | **294,199** |
| Filed: | **Jan. 6, 1989** |

[51] Int. Cl.[5] ..... B65D 33/06
[52] U.S. Cl. ..... 383/20; 383/107
[58] Field of Search ..... 383/20, 17, 6, 107

[56] References Cited

FOREIGN PATENT DOCUMENTS 63-32148 3/1988 Japan .

*Primary Examiner*—Stephen P. Garbe

*Agent, Attorney, or Firm*—Collard, Roe & Galgano

[57] ABSTRACT

A shopping bag having handles, which are passed through slits produced a foldable tab extended from the rim of the bag. The handles are bonded to reinforcement straps attached to the bag, over which the foldable tab is folded with the handles protruded through the handle-receiving slits.

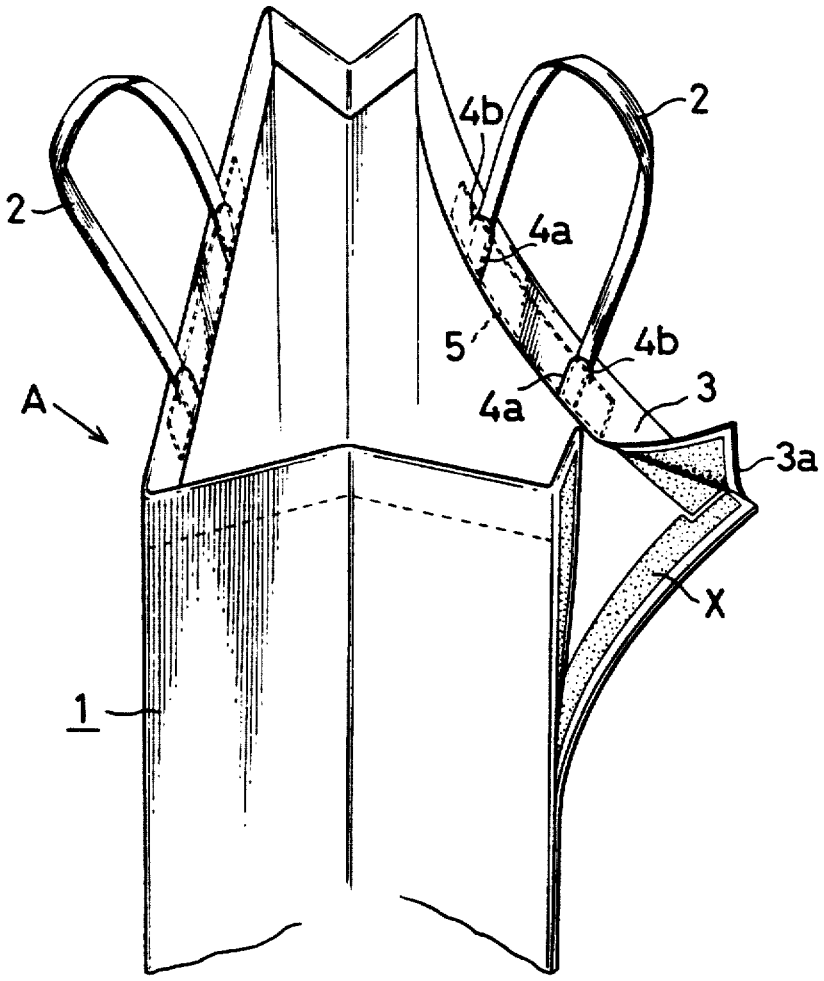

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–4 are cancelled.

* * * * *